US009327932B2

(12) United States Patent
Mazzaccherini et al.

(10) Patent No.: US 9,327,932 B2
(45) Date of Patent: May 3, 2016

(54) REWINDING MACHINE AND WINDING METHOD

(75) Inventors: Graziano Mazzaccherini, Porcari (IT); Romano Maddaleni, Bientina (IT)

(73) Assignee: Fabio Perini S.p.A., Lucca (IT)

( * ) Notice: Subject to any disclaimer, the term of this patent is extended or adjusted under 35 U.S.C. 154(b) by 132 days.

(21) Appl. No.: 13/996,317

(22) PCT Filed: Dec. 19, 2011

(86) PCT No.: PCT/IT2011/000408

§ 371 (c)(1),
(2), (4) Date: Jul. 9, 2013

(87) PCT Pub. No.: WO2012/085953

PCT Pub. Date: Jun. 28, 2012

(65) Prior Publication Data

US 2013/0284849 A1 Oct. 31, 2013

(30) Foreign Application Priority Data

Dec. 22, 2010 (IT) ..... FI2010A0245

(51) Int. Cl.
*B65H 19/28* (2006.01)
*B65H 19/22* (2006.01)

(52) U.S. Cl.
CPC ..... *B65H 19/2238* (2013.01); *B65H 19/2269* (2013.01); *B65H 19/2276* (2013.01); *B65H 2301/41466* (2013.01)

(58) Field of Classification Search
CPC ..... B65H 19/2269; B65H 2408/235
USPC ..... 242/532.2–532.3, 533, 541.1, 542, 242/542.1–542.2
See application file for complete search history.

(56) References Cited

U.S. PATENT DOCUMENTS

| | | | | |
|---|---|---|---|---|
| 5,137,225 | A * | 8/1992 | Biagiotti | 242/521 |
| 5,538,199 | A | 7/1996 | Biagiotti | |
| 5,603,467 | A | 2/1997 | Perini et al. | |
| 5,639,046 | A | 6/1997 | Biagiotti | |
| 5,690,296 | A | 11/1997 | Biagiotti | |
| 5,839,680 | A | 11/1998 | Biagiotti | |
| 6,098,916 | A * | 8/2000 | Matteucci et al. | 242/527.3 |
| 6,565,033 | B1 | 5/2003 | Biagiotti | |
| 6,752,345 | B2 | 6/2004 | Betti et al. | |
| 7,942,363 | B2 | 5/2011 | Gelli et al. | |
| 2005/0279875 | A1 | 12/2005 | Biagiotti et al. | |
| 2007/0176039 | A1 * | 8/2007 | Gelli et al. | 242/533.3 |
| 2009/0101748 | A1 | 4/2009 | Maddaleni et al. | |

* cited by examiner

*Primary Examiner* — Sang Kim
(74) *Attorney, Agent, or Firm* — Breiner & Breiner, L.L.C.

(57) ABSTRACT

The rewinding machine includes a path for feeding a web material; a first winding roller and a second winding roller defining a nip, across which the web material passes; downstream of the nip a third winding roller with movable axis, cooperating with the first winding roller and the second winding roller to form a winding cradle for the rolls. An auxiliary winding roller with movable axis is also provided, which can be inserted between the first winding roller and the second winding roller downstream of the nip.

28 Claims, 8 Drawing Sheets

5
5A
5B
5C
5D
2
3
N
$f_N$
1
7
22
23
25
25A
27
29
37
39
33
43
43A
58
59
60
11
11A
55
57
17
17A
54
$f_{11}$
61
61A
56
15
13
13A
$f_{13}$
24
II
63
65
21
19
69
69A
$f_{69}$
67

I
IA
IA
I
21
31
17
17A
11B
33
51
41
39
43
35
45
47
48
11
13
43A
11A
53
54
55
56
57
58
59
60

CENTRAL CONTROL UNIT
MOTOR 1
MOTOR 2
MOTOR 3

5
5C
5B
5A
5D
2
3
1
N
7
43
43A
22
23
23A
25
27
29
25A
37
39
48
11
11A
61
61A
17
15
LC
LT
13
13A
24
L1
63
65
21
19
69
69A
67

5
5C
5B
5D
5A
2
3
N
fN
1
29
27
25
7
23
22
43
37
39
25A
11A
48
L1
17
11
61
61A
L2
15
13A
24
62
13
63
21
65
19
69
67
69A
f69

5
5C
5D
5B
5A
N
2
3
1
29
27
22
7
43
43A
25
25A
37
39
fN
48
11
11A
17
61
23
L2
15
24
13A
13
61A
63
21
65
19
69
67
69A
f69

5
5C
5B
5A
5D
N
2
3
1
29
27
f23
7
25
fN
43
22
23
43A
48
37
39
25A
11
11A
L2
17
61
15
24
61A
13A
13
63
21
65
19
69
67
69A
f69

5
5C
5B
5A
5D
N
2
3
1
29
27
25
7
22
23
43
43A
48
fN
37
39
25A
11
11A
L2
17
61
61A
15
13A
13
24
63
21
65
19
69
69A
67
f69

REWINDING MACHINE AND WINDING METHOD

TECHNICAL FIELD

The present invention relates to the field of the web material converting machines, and in particular the field of paper converting machines. More in particular, the invention relates to the so-called rewinding machines, that wind a web material, for example a single- or multi-ply tissue paper sheet, to form rolls destined for consumption.

BACKGROUND ART

In the paper converting field and in other industrial sectors machines are known to produce rolls of web material starting from reels of large diameter, which are unwound in specific unwinding machines that feed winding or rewinding machines. These latter wind the web material to form rolls of diametrical dimensions equal to the dimensions of the product destined for consumption. These rolls present, in some cases, an axial extension which is a multiple of the length of the rolls destined for consumption, and are therefore subsequently cut to transform the rolls or logs produced by the rewinding machines into individual rolls or small rolls of lower diameter for packaging and marketing.

These rolls are usually formed through winding around a tubular winding core, typically made of cardboard or plastic. The winding core remains inside the finished product. US-A-2005/0279875 and other documents of the same patent family describe a rewinding machine particularly designed for producing tissue paper rolls around winding cores.

In other cases the rolls are wound around removable spindles, that are extracted from the roll or log once this latter has been finished and unloaded from the rewinding machine. U.S. Pat. No. 6,565,033 and U.S. Pat. No. 6,752,345 describe a winding system with removable spindle.

Also machines have been provided for producing logs or rolls of web material, typically tissue paper, without winding spindle or core. U.S. Pat. Nos. 5,538,199; 5,603,467; 5,639,046; 5,690,296; US-A-2009/0101748 describe examples of this machine type.

The machine described in U.S. Pat. No. 5,639,046 comprises for instance: a path for feeding the web material; a first winding roller and a second winding roller defining a nip across which the web material passes; downstream of the nip, a third winding roller with a movable axis cooperating with the first winding roller and with the second winding roller to form a winding cradle for said rolls and, upstream of the nip, a surface delimiting a channel for forming the first winding turns of each roll.

This winding technique has several advantages if compared with the traditional systems for winding around winding cores or spindles, and also if compared with the systems for winding around removable spindles. In particular, with the same outer diameter, the rolls formed without winding core or spindle have a greater quantity of wound web material, i.e. they have, with the same quantity of wound material, a lower bulk. The storage and transport costs are thus reduced. As there is no need for a winding core, there is consequently no need in the production line for a machine for producing the winding cores, a so-called core winder. This leads to a greater ease in the line arrangement, to space-saving and to a reduction in the labor costs for managing the production line. Also the production costs decrease, as there is no more consumption of cardboard and glue necessary for producing the tubular winding cores.

If compared with the winding systems with removable spindle, the winding systems without spindle and without tubular core do not require complex mechanisms for removing and recycling the winding spindles.

SUMMARY OF THE INVENTION

The object of the present invention is to provide a rewinding machine. in particular a peripheral, preferably automatic and continuous rewinder, allowing to produce full rolls, i.e. rolls without winding spindle or core, of higher quality than the rolls that can be obtained with known machines. In the present description, peripheral rewinding machine means a machine, wherein winding is obtained by imparting to the roll a rotary and winding motion through contact with movable surface members, i.e. members acting on the cylindrical surface of the roll being formed. The machine is automatic as subsequent winding cycles are automatically performed without the need for the operator to intervene. The machine is furthermore called continuous as winding substantially occurs at a continuous feed speed, without interruption, preferably at a substantially constant speed of the web material being wound.

Substantially, according to the invention a rewinding machine is provided for producing rolls of web material comprising: a path for feeding the web material; a first winding roller and a second winding roller defining a nip across which the web material passes; downstream of said nip, a third winding roller with movable axis cooperating with the first winding roller and with the second winding roller to form a winding cradle for winding said rolls, wherein, downstream of the nip between the first and the second winding roller an auxiliary winding roller with movable axis is furthermore provided, which can be inserted between the first winding roller and the second winding roller. The auxiliary winding roller approaches the roll in the initial forming phase before the roll formed during the previous cycle has been completely unloaded from the machine, and therefore before the third winding roller with movable axis has come into contact with the new roll being formed.

This arrangement allows a better control over the roll in the first forming phase. This allows, in some embodiments, a greater uniformity in the winding density. In particular, if the roll is kept into contact with at least three winding rollers substantially over all the winding cycle, the density change is avoided that, in the known winding machines without core, is due to the fact that the first winding phase is performed between only two winding rollers. In fact, during this phase the pressure applied by the winding rollers is high, to maintain control and grip over the roll, and the winding density is consequently higher than during the remaining phase of the roll forming cycle. The present invention can reduce or eliminate this problem.

In other preferred embodiments of the invention the auxiliary winding roller has a smaller diameter than the first winding roller, the second winding roller and the third winding roller. The diameter of the auxiliary winding roller can be for instance less than one third and preferably equal to or lower than a quarter of the diameter of the smallest among the first, the second, and the third winding roller. The third winding roller has usually a smaller diameter than the first and the second winding roller. Such a reduced diameter of the auxiliary winding roller allows to insert this roller deeply inside the space delimited between the first and the second winding roller, moving it near the median plane of the nip between the rollers. It is also possible for the cylindrical surface of the auxiliary winding roller to enter until the laying plane of the axes of the first and of the second winding roller, i.e. until (or beyond) the centerline of the nip between the first and the second winding roller. The auxiliary winding roller is preferably movable along a substantially circular trajectory, which is preferably nearly coaxial with the first winding roller. This allows to obtain a particularly compact and simple structure. However, it is also possible to support and move the auxiliary winding roller in a different manner.

In advantageous embodiments, among the three winding rollers the first winding roller, around which the auxiliary winding roller moves, is the one which guides the web material, i.e. the one around which the feed path of the web material extends.

In some embodiments the auxiliary winding roller is supported by a plurality of support elements forming a comb-shaped bearing structure. The auxiliary winding roller is preferably subdivided into a plurality of substantially coaxial cylindrical elements. In some embodiments the cylindrical elements are keyed on a common shaft. The comb-shaped bearing structure forms a series of supports distributed along the axial extension of the auxiliary winding roller, allowing this latter to have a very small diameter. The shaft, onto which the cylindrical elements forming the auxiliary winding roller are keyed, is advantageously motorized. A motor is preferably provided for the rotation of the auxiliary winding roller distinct from the motor or motors controlling the rotation of the other rollers of the machine. These can be driven into rotation by a single common motor, or by two or also by three distinct motors, one for each said first, second, and third winding roller. A central control unit can electronically control the motors, maintaining them phased. To this end encoders for the various motors could be adequately provided.

In improved embodiments of the invention the first winding roller is supported with a movable axis. This allows to change in a controlled manner the centre-to-centre distance between the first and the second winding roller, to optimize the initial phase of winding of each roll and the passage thereof through the nip between the first winding roller and the second winding roller toward the winding cradle defined between the first, the second, and the third winding roller.

In some embodiments the first winding roller is supported by a pair of arms hinged around a pivoting axis substantially parallel to the axis of rotation of said first winding roller. This pivoting axis of the arms supporting the first winding roller can be advantageously arranged downstream of the nip between the first and the second winding roller, near the oscillation or rotation axis of a pair of arms supporting the third winding roller and imparting thereto the necessary pivoting movement to allow a controlled diameter increase of each roll being formed in the winding cradle.

In advantageous embodiments the motor driving the auxiliary winding roller into rotation can be carried by one of the arms supporting the first winding roller.

In some embodiments, starting the winding of a roll can directly occur between the first and the second winding roller. These winding rollers can be moved for instance towards one another to grip the web material in the nip between the rollers, cause the breakage thereof and start to wind the initial free end formed by severing the web material. In other embodiments the machine preferably comprises a plate upstream of the nip between the first winding roller and the second winding roller. The plate can be provided with a movement toward the first winding roller to pinch the web material between the plate and the roller. In advantageous embodiments the plate forms with said first winding roller a channel inside which the winding of the rolls starts. The plate is preferably arched and extends around the first winding roller with a concavity facing the rotation axis of the first winding roller. The plate is preferably provided with a gradual movement away from the winding roller to allow forming the first turns of web material of each roll.

The third winding roller and the auxiliary winding roller are preferably controlled so that, while a first roll in the winding final phase is moved away from the first winding roller into contact with the second winding roller and the third winding roller, said auxiliary winding roller is inserted between the first winding roller and the third winding roller towards the nip formed between the first and the second winding roller, towards a second roll in initial winding phase passing across said nip and coming into contact with said auxiliary winding roller.

The third winding roller and the auxiliary winding roller are preferably controlled so that, when the first roll has been discharged from the winding cradle, the third winding roller is put into contact with the second roll for at least one part of the winding cycle.

According to another aspect of the invention, a method is provided for winding rolls of web material without a winding core, comprising the steps of:

- providing a first winding roller and a second winding roller defining, there between, a nip across which the web material is fed;
- providing a third winding roller with movable axis downstream of said nip, defining with said first winding roller and said second winding roller a winding cradle;
- winding at least one part of a first roll of web material into contact with said first winding roller, said second winding roller and said third winding roller;
- moving the first roll away from the first winding roller maintaining it into contact with said second winding roller and said third winding roller;
- inserting an auxiliary winding roller between said first roll and said first winding roller;
- engaging a second roll in an initial winding phase between said first winding roller, said second winding roller and said auxiliary winding roller, after having interrupted the web material when the first roll has been formed.

In some embodiments, the method according to the present invention comprises the steps of:

- unloading the first roll from the winding cradle;
- moving the third winding roller towards the second roll, maintaining the second roll into contact with said first winding roller, said second winding roller and said auxiliary winding roller for a part of the winding cycle.

In preferred embodiments the method according to the invention comprises the step of moving the auxiliary winding roller away from the second roll, continuing winding the second roll into contact with the first winding roller, the second winding roller and the third winding roller.

Further features of the method and the machine according to the invention are described hereunder with reference to an embodiment and in the appended claims, which form an integral part of the present description.

BRIEF DESCRIPTION OF THE DRAWINGS

The invention will be better understood by following the description below and the attached drawing, which shows a non-limiting practical embodiment of the invention. More in particular, in the drawing.

DETAILED DESCRIPTION OF AN EMBODIMENT OF THE INVENTION

Figure 1:
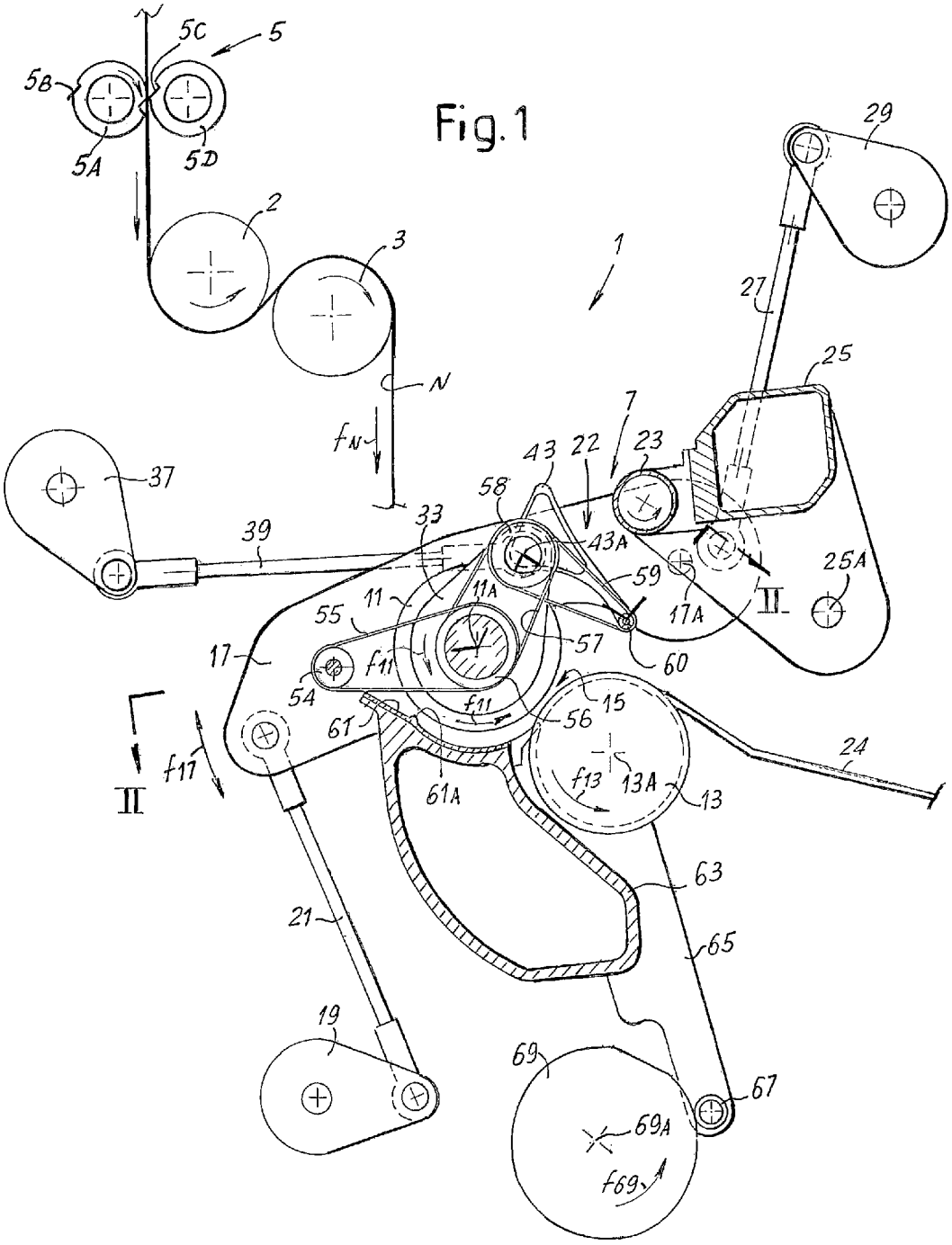
FIG. 1 shows a schematic cross-section of the machine in one embodiment of the invention, according to the line I-I of FIG. 2.

With initial reference to FIGS. 1, 1A, and 2, the main elements of a rewinding machine according to the invention will be described, only as regards the parts and the components necessary for comprehending the invention. The machine in its entirety can comprise other components, groups, devices and accessories, known to those skilled in the art and that will not be described.

The machine, indicated in its entirety with number 1, comprises a feed path for a web material N. The path is defined by a series of rollers and, in particular, by a pair of rollers 2 and 3 arranged downstream of a perforating unit 5 and upstream (with respect to the feed direction of the web material N) of a winding head indicated in its entirety with number 7. The perforating unit 5 comprises, in a known manner, a rotating roller 5A comprising blades 5B cooperating with a counter blade 5C carried by a fixed roller or by a beam 5D. The structure of the perforating unit 5 is known per se and will not be described in greater detail. The perforating unit 5 transversally perforates the web material N, which advances at a substantially constant speed according to the arrow fN, forming perforation lines substantially orthogonal to the machine direction, i.e. to the longitudinal extension of the web material N. The perforation lines subdivide the web material N into small sheets that can be detached singularly.

In an advantageous embodiment the winding head 7 comprises a first winding roller 11 and a second winding roller 13, between which a nip 15 is defined through which the web material N is advanced. The first winding roller 11 rotates according to the arrow fl 1 about its own axis 11 A, whilst the second winding roller 13 rotates about an axis 13A according to the arrow f13.

In some advantageous embodiments the first winding roller 11 is supported at its ends by a pair of arms 17, only one of which is shown in FIG. 1, pivoted around an oscillation axis 17A. The oscillation of the arms 17 according to the double arrow fl 7 is imparted by an actuator 19 connected to the pair of arms 17 through rods 21 (see also FIG. 2).

The first winding roller 11 and the second winding roller 13, together with a third winding roller 23, define a winding cradle 22 inside which occurs at least one part of the winding cycle of each log or roll formed by the rewinding machine 1, as it will be better explained hereunder with reference to the sequence of FIGS. 3 to 8.

The third winding roller 23 is supported by a pair of oscillating arms 25, hinged around an axis 25A so that the axis 23A of the third winding roller 23 can move around the axis 25A. The oscillation of the arms 25 is controlled by an actuator 29 through rods 27. The axes 11A, 13A, and 23A of the winding rollers 11, 13, and 23 are substantially parallel to one another.

Figures 1A, 2:
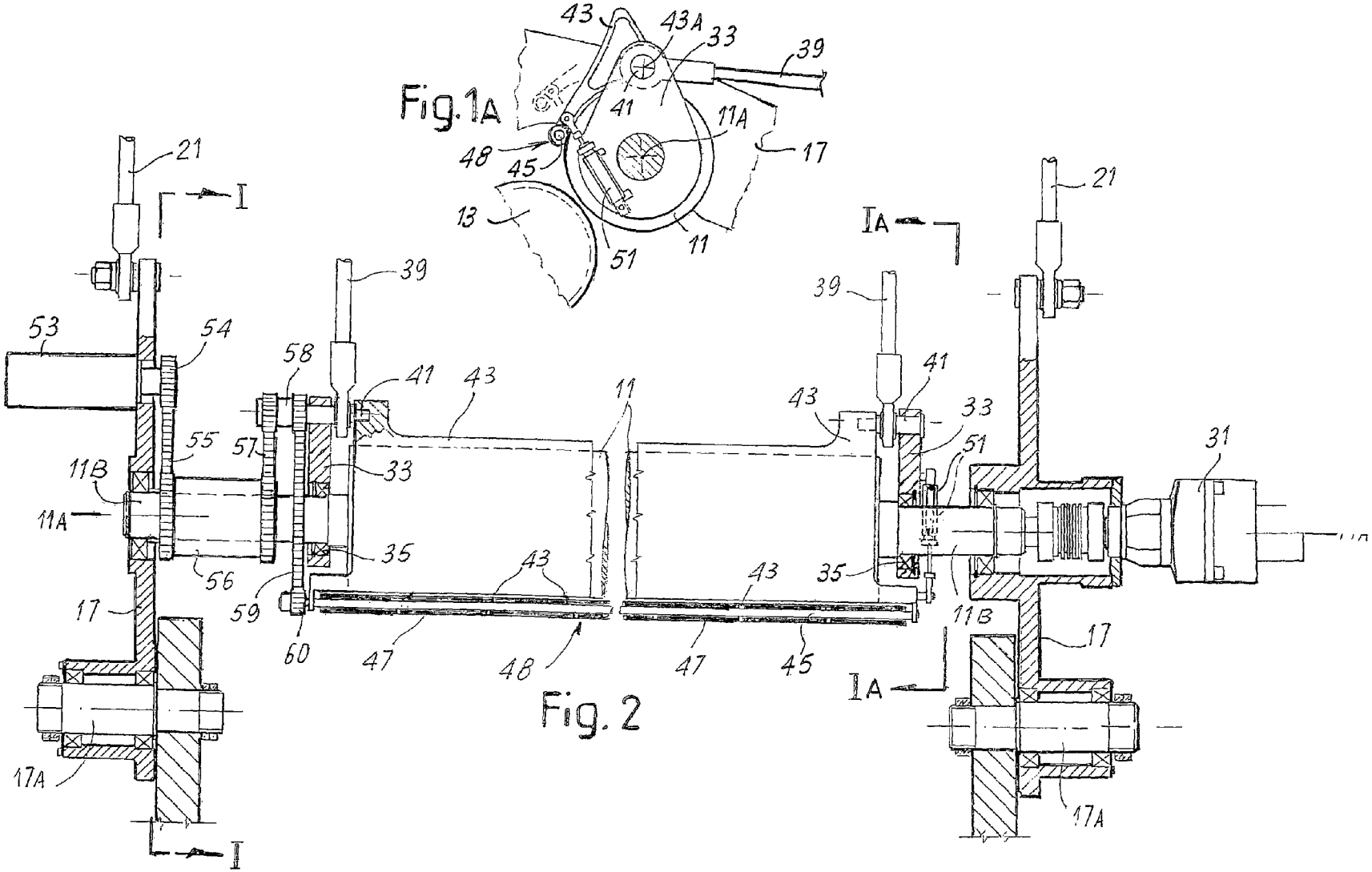
FIG. 1A shows a cross-section according to $I_A$-$I_A$ of FIG. 2.
FIG. 2 shows a section according to the line II-II of FIG. 1.

In FIG. 2, 11 B indicates the rotation shaft of the first winding roller 11. Rotation is imparted to the shaft 11B, and therefore to the first roller 11, by a motor 31 that, in the illustrated example, is coaxial with the first winding roller 11 and is carried by one of the arms 17.

Flanks 33 are supported on the shaft 11B through the interposition of bearings 35. The flanks 33 can thus oscillate or rotate about the axis 11A of the first winding roller 11. The oscillation or rotation movement of the flank 33 is imparted by an actuator 37 through rods 39 hinged at 41 to the two flanks 33 (see in particular FIG. 2). A comb-shaped bearing structure 43 is supported on the flanks 33, which supports a shaft 45 with an axis substantially parallel to the axis 11A of the first winding roller 11. Cylindrical coaxial elements 47 are keyed on the shaft 45 so as substantially to form an auxiliary winding roller 48, whose axis is parallel to the axes of the winding rollers 11, 13, and 23. As shown in particular in FIGS. 1 and 2, the diameter of the auxiliary winding roller 48 is much smaller than the diameter of the winding rollers 11, 13, and 23. The diameter of the auxiliary winding roller 48 is typically of such dimensions that it can be inserted inside the space defined between the first winding roller 11 and the second winding roller 13 downstream of the nip 15 for feeding the web material, until arriving near the plane on which the axes 11A and 13A of the rollers 11 and 13 are located. Substantially, the auxiliary winding roller 48 can be practically brought to the nip 15, i.e. at the central point of this nip matching with the plane on which the above mentioned axes 11A and 13A of rotation are located.

The bearing structure 43 supporting the auxiliary winding roller 48 is hinged about an axis 43A carried by the flanks 33, preferably matching with the axis around which the rods 39, which connect the flanks 33 to the actuator 37, are hinged. An elastic element 51, visible in particular in FIG. 2, is mounted on at least one of the flanks 33. The elastic element 51 can be constituted by a pneumatic cylinder-piston actuator, acting as an air spring. According to other embodiments, the elastic element 51 may comprise a tension spring.

The elastic element 51 holds the bearing structure 43, and therefore the auxiliary winding roller 48, in a position of maximum approach to the rotation axis 11A of the first winding roller 11, however allowing a movement of the winding roller 48 away from the rotation axis 11 A of the first winding roller 11 in case of emergency, as it will be explained below. If the elastic element 51 is in the form of a cylinder-piston actuator, it can be also used in some embodiments to lift the auxiliary winding roller 48 and the corresponding bearing structure 43 for machine maintenance, repair or cleaning purposes.

In some embodiments the auxiliary winding roller 48 is driven into rotation by its own motor 53. The motor 53 is preferably carried by one of the arms 17 supporting the first winding roller 11. More in particular, to optimize the bulk and the arrangement of the various machine members, the motor 53 is carried by the arm 17 opposite to the arm 17 carrying the motor 31 that actuates the first winding roller 11. The motor 53 actuates a pulley 54 that transmits the motion, through a belt 55, to a double pulley 56 advantageously supported on the shaft 11B of the first winding roller 11. Around the double pulley 56 a further belt 56 is driven, which transmits the motion, through a further double pulley 58, to a third belt 59, driven in turn around a further pulley 60 keyed on the shaft 45 of the auxiliary winding roller 48. The pair of flanks 33 supporting the bearing structure 43 can oscillate around the axis 11A of the first winding roller 11 under the control of the actuator 37, thus making the axis of the auxiliary winding roller 48 to follow a circular trajectory coaxial to the winding roller 11, whilst the arrangement of belts and pulleys described above endures the rotary motion transmission from the motor 53 to the auxiliary winding roller 48 in any angular position of the bearing structure 43 and of the flanks 33.

Upstream of the nip 15 (relative to the feed direction of the web material) a plate 61 is arranged, carried by a beam 63 which is, in turn, carried by flanks 65 hinged around the axis 13A of the second winding roller 13. At least one of the flanks 33 carries a feeler for a cam 69 rotating about an axis 69A according to the arrow f69. The plate 61 can advantageously have a projection 61A, extending transversally to the feed direction of the web material N and therefore parallel to the axis 11A of the first winding roller 11, for gripping the web material N on the cylindrical surface of the first winding roller 11 so as to cause the severing thereof in a synchronized manner with the winding cycle of each roller, as described below with reference to the operation cycle illustrated in the sequence of FIGS. 3 to 8.

Figure 3:
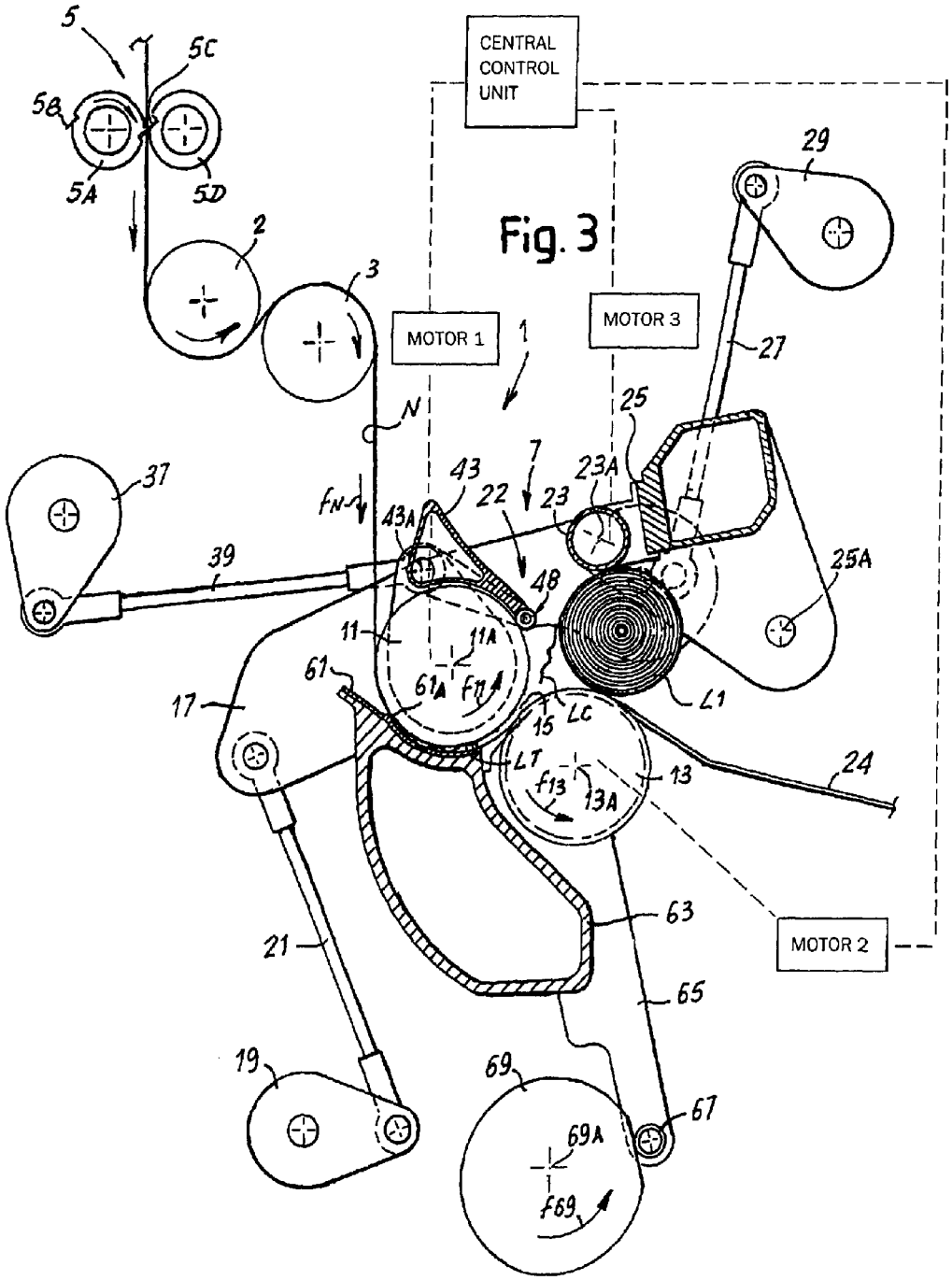
FIGS. 3 to 8 show a sequence of subsequent steps of a roll or log winding cycle in the machine of FIGS. 1 and 2.

The machine described hereinbefore operates in the following way. In FIG. 3 a first log or roll L1 of web material N has been completed and is in a position comprised between the second winding roller 13 and the third winding roller 23, during the ejection phase toward a slide 24. The forward movement of the completed roll L1 toward the chute 24 can be obtained by varying the rotation speeds of the winding rollers, for instance by reducing the rotation speed of the winding roller 13 and/or increasing the speed of the winding roller 23, so as to generate a difference between the peripheral speeds of the rollers 13 and 23. The change in the peripheral speed of the rollers also allow further operations, for instance tensioning the web material N to facilitate the severing thereof and making a roll in the initial forming phase to pass across the nip 15.

To start winding a subsequent roll, the plate 61 is pressed against the cylindrical surface of the first winding roller 11, so that the projection 61A of the plate 61 pinches the web material N against the surface of the winding roller 11. The movement of the plate 61 toward the first winding roller 11 is controlled by the cam 69 acting on the feeler 67 causing the flanks 65, carrying the beam 63 supporting the plate 61, to oscillate about the axis 13A. As the surface of the plate 61 is substantially stationary, the web material N pinched between the projection 61A of the plate 61 and the cylindrical surface of the first winding roller 11 is suddenly stopped, thus causing severing of the web material N between the pinch point defined by the projection 61A and the completed roll L1. To this end it is possible to provide that the surface of the plate 61 or a part thereof (for example the projection 61A) is treated or coated so as to have a friction coefficient preferably greater than the friction coefficient of the cylindrical surface of the winding roller 11.

In some embodiments the projection 61A can be discontinuous, i.e. it can have a series of interruptions along the direction transverse to the feed direction of the web material N. Vice versa, the winding roller 11 can have alternating annular bands characterized by a different friction coefficient. A series of annular bands with lower friction coefficient and a series of annular bands with greater friction coefficient can be arranged longitudinally along the winding roller 11 in such positions that the annular bands with greater friction coefficient are arranged at the interruptions of the projection 61A. The annular bands with high friction coefficient grip therefore the web material N to pull and wind it, whilst the annular bands with low friction coefficient allow the web material to slip when it is pinched by the discontinuous projection 61A at said annular bands with lower friction coefficient.

Severing preferably occurs at a perforating line formed by the perforator 5. To this end, the winding cycle is synchronized with the angular position of the perforating roller 5A so that, when severing occurs to interrupt the web material after a roll L1 has been completely wound, a perforating line is in the most adequate position between the projection 61A of the plate 61 and the completed roll L1.

In this phase of the winding cycle the auxiliary winding roller 48 is spaced from the path of the web material N, i.e. at a certain distance from the nip 15 through which the web material N is fed.

The shape and the position of the plate 61 relative to the cylindrical surface of the winding roller 11 are such that the rotary motion of the winding roller 11 makes the free initial end of the web material, generated by the breakage along the perforating line in the phase illustrated in FIG. 3, twist around itself. As a result, the web material starts to form a winding nucleus that moves forward rolling on the surface of the plate 61 along the channel defined between the surface of said plate and the cylindrical surface of the first winding roller 11.

Figure 4:
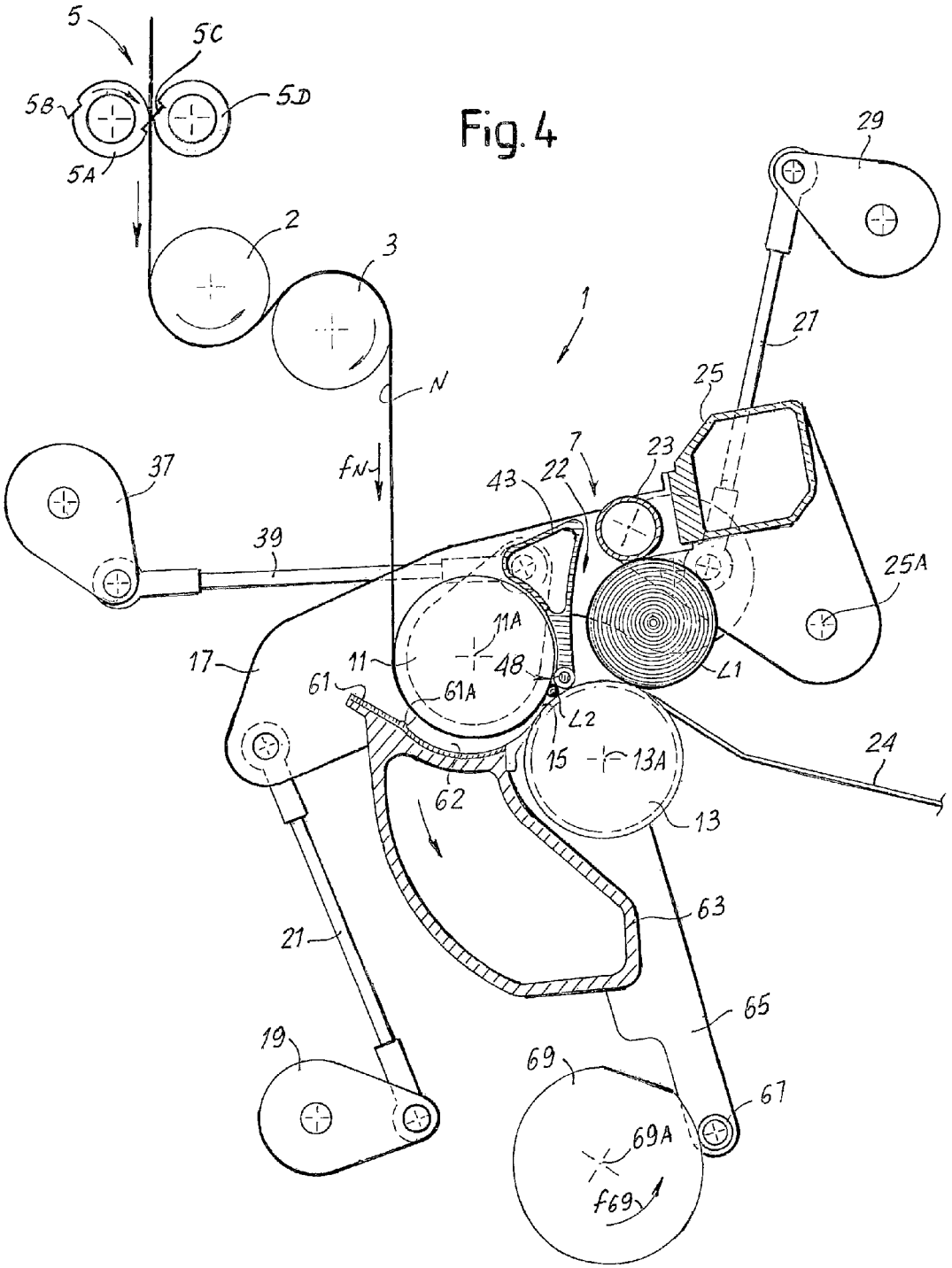

FIG. 4 shows a subsequent phase, wherein the log or roll L1 under completion is still held between the second winding roller 13 and the third winding roller 23, whilst an initial winding nucleus of a second roll or log L2 has been formed in the channel 62 defined between the pate 61 and the cylindrical surface of the first winding roller 11. This initial portion or central nucleus of the second roll L2 has crossed the centerline of the nip 15 between the first winding roller 11 and the second winding roller 13, i.e. it has passed the plane on which the axes 11A and 13A of rotation of the first and of the second winding roller 11 and 13 are located, and has come into contact with the second winding roller 13.

As the web material N has been severed and the tail end LC is completing its winding around the roll L1, the auxiliary winding roller 48 can be lowered and moved toward the roll L2 in the initial forming phase, moving toward the area of minimum distance between the winding roller 11 and the winding roller 13. Thanks to its highly reduced diameter, the auxiliary winding roller 48 can be inserted deeply in the space defined between the first winding roller 11 and the second winding roller 13 downstream of the centerline of the nip 15, so as to come into contact with the second roll L2 in the initial forming phase when this second roll L2 still has an extremely small diameter. It is therefore possible to start winding the new roll L2 between three winding rollers 11, 13, 48 in an initial phase of the winding cycle.

FIG. 4 shows the plate 61 that, once the roll L2 has come into contact with the second winding roller 13, can be moved away from the cylindrical surface of the first winding roller 11 due to the rotation of the cam 69.

Figure 5:
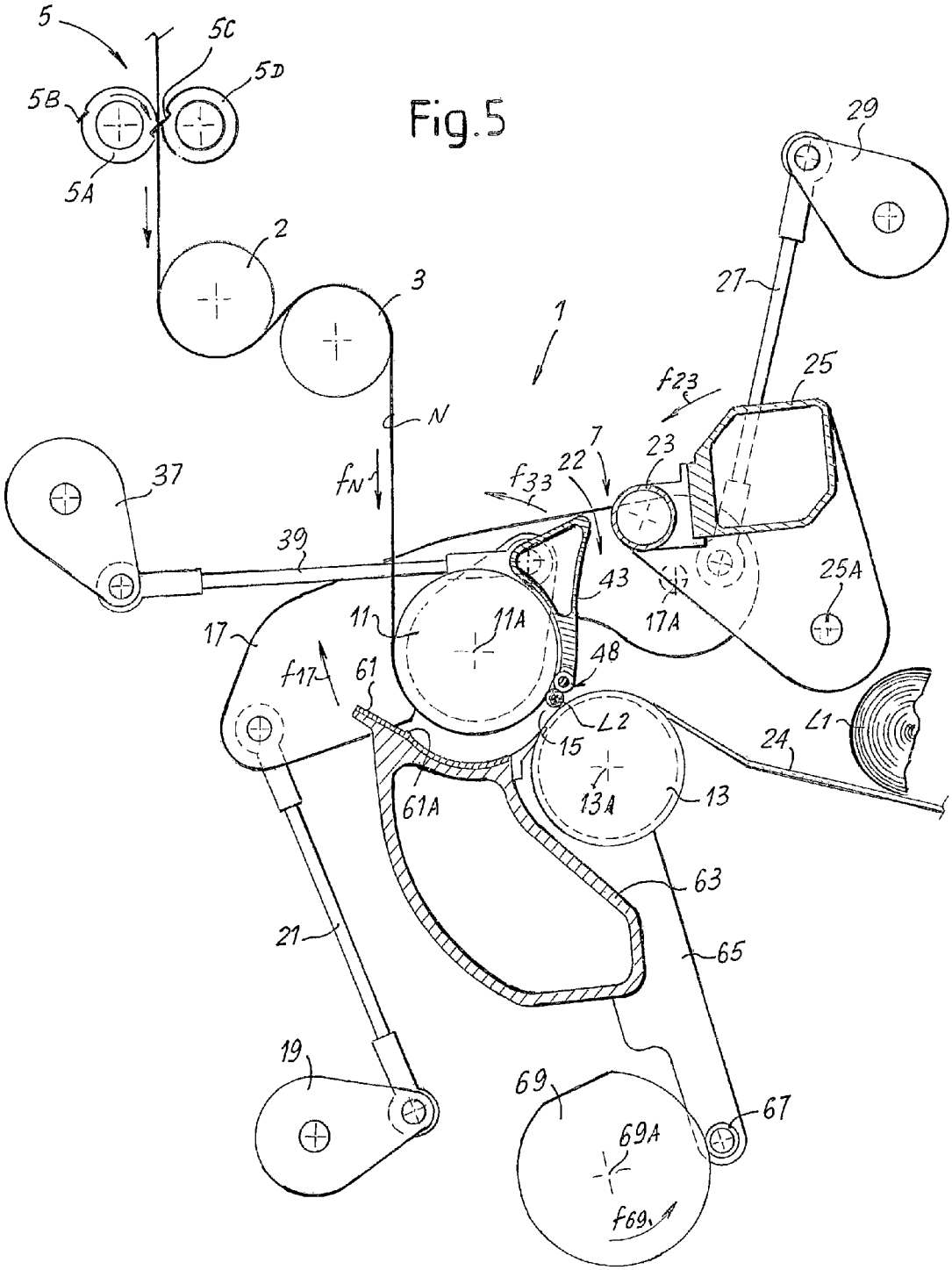

FIG. 5 shows an arrangement of the rewinding machine in a later phase than that illustrated in FIG. 4. The first roll L1 has been ejected from the winding cradle formed by the winding rollers 11, 13, and 23, so that the third winding roller 23 can start its lowering movement (arrow f23) toward the first winding roller 11 and the second winding roller 13. In this phase the roll L2 being formed is still into contact with the first winding roller 11, the second winding roller 13 and the auxiliary winding roller 48. Said second roll L2 is increased in diameter due to the rotation of the winding rollers 11, 13, and 48 and to the substantially constant feed speed of the web material N.

In this winding phase, to allow easy increase in the diameter of the second roll L2 without it being excessively pressed, the arms 17 supporting the first winding roller 11 pivot about the rotation axis 17A according to the arrow f17 under the control of the actuator 19 and the rods 21. Thus, the centre distance between the first winding roller 11 and the second winding roller 13 increases, as well as the available space for the diameter increase of the second roll L2.

Again to allow the increase in the diameter of the roll L2 and a movement thereof toward the exit of the space between the rollers 11 and 13, the flanks 33 supporting the bearing structure 43, that supports the auxiliary winding roller 48, also rotate according to the arrow f33 under the control of the actuator 37 and the rods 39.

This entails a gradual movement of the auxiliary roller 48 away fro the nip 15 defined between the first winding roller 11 and the second winding roller 13. Displacements of the axes of the rollers 11 and 48 can be advantageously controlled according to the thickness of the web material N and the feed speed, as the increase over time in the diameter of the roll L2 depends upon these two parameters. By controlling the movement of the axes of the rollers 11 and 48 it is furthermore possible to control the winding density of the roll L2. By acting on the movement of the rotation axes of the rollers 11 and 48 it is possible to make this density be nearly constant or variable according to the roll diameter. Winding the roll into contact with three winding rollers 11, 13, 48 since the first winding phase allows to keep the density of the first turns at a limited value, thus avoiding formation of a roll presenting an inner part with substantially greater density than the outer part.

In this phase of the winding cycle the peripheral speed of the winding roller 11 and the peripheral speed of the winding roller 13 are so controlled as to cause a controlled forward movement of the roll L2. In fact, the centre of the roll L2 being formed moves forward at a speed equal to half the difference between the peripheral speeds of the above mentioned rollers 11 and 13. More in particular, to allow a gradual and controlled forward movement of the roll L2 being formed, in an advantageous embodiment the peripheral speed of the second winding roller 13 has been temporarily made lower than the peripheral speed of the first winding roller 11 and of the auxiliary winding roller 48, which rotate preferably at a constant peripheral speed equal to the linear feed speed of the web material N. As already mentioned, thanks to this difference in the peripheral speeds of the rollers 11 and 13 the centre of the roll L2 being formed moves forward at a speed equal to half the difference between the peripheral speeds of the winding roller 11 and of the winding roller 13. As shown in FIG. 5, the roll L2 is held and controlled between three winding rollers 11, 13, and 48.

Figure 6:
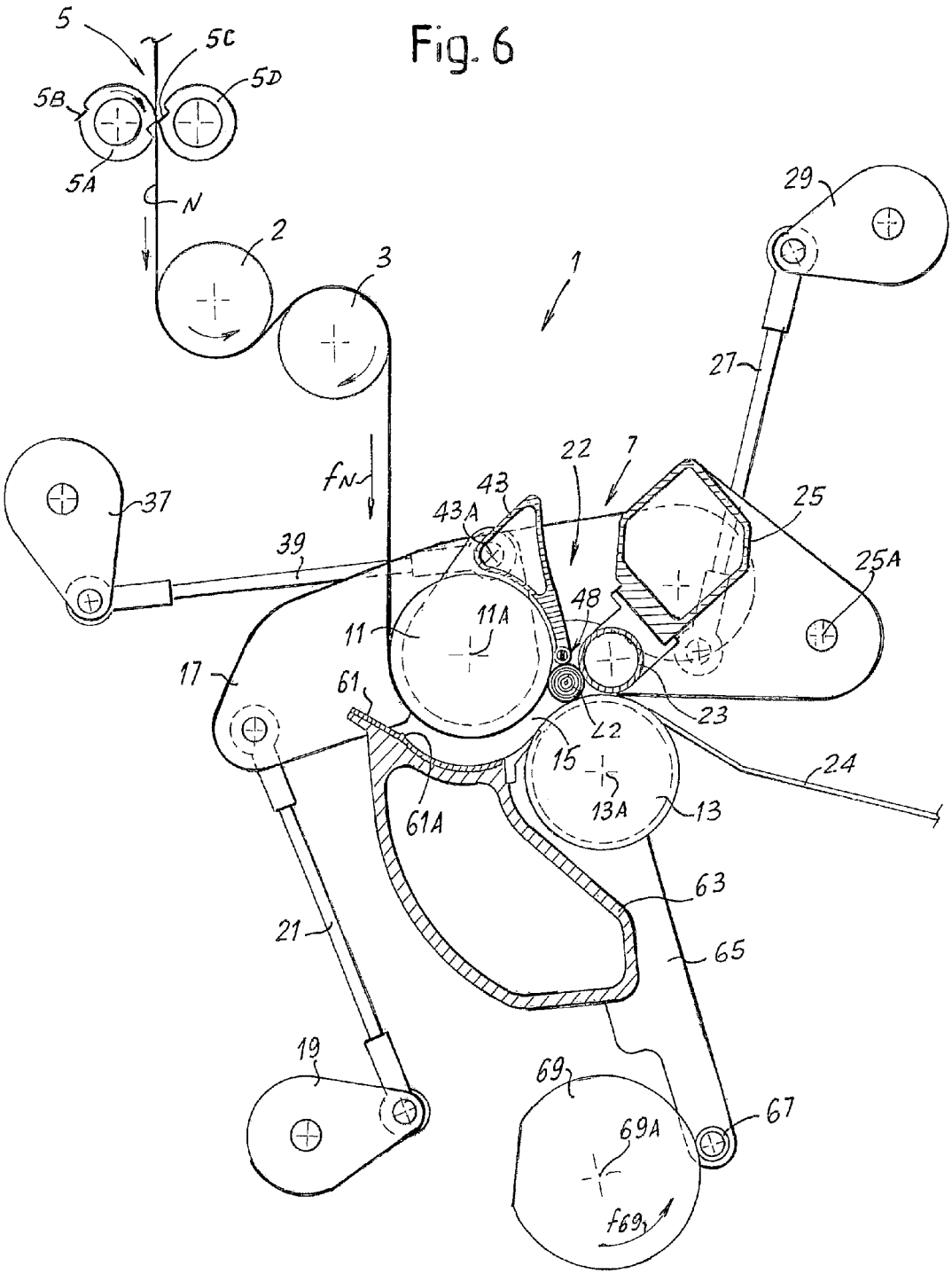
Figure 7:
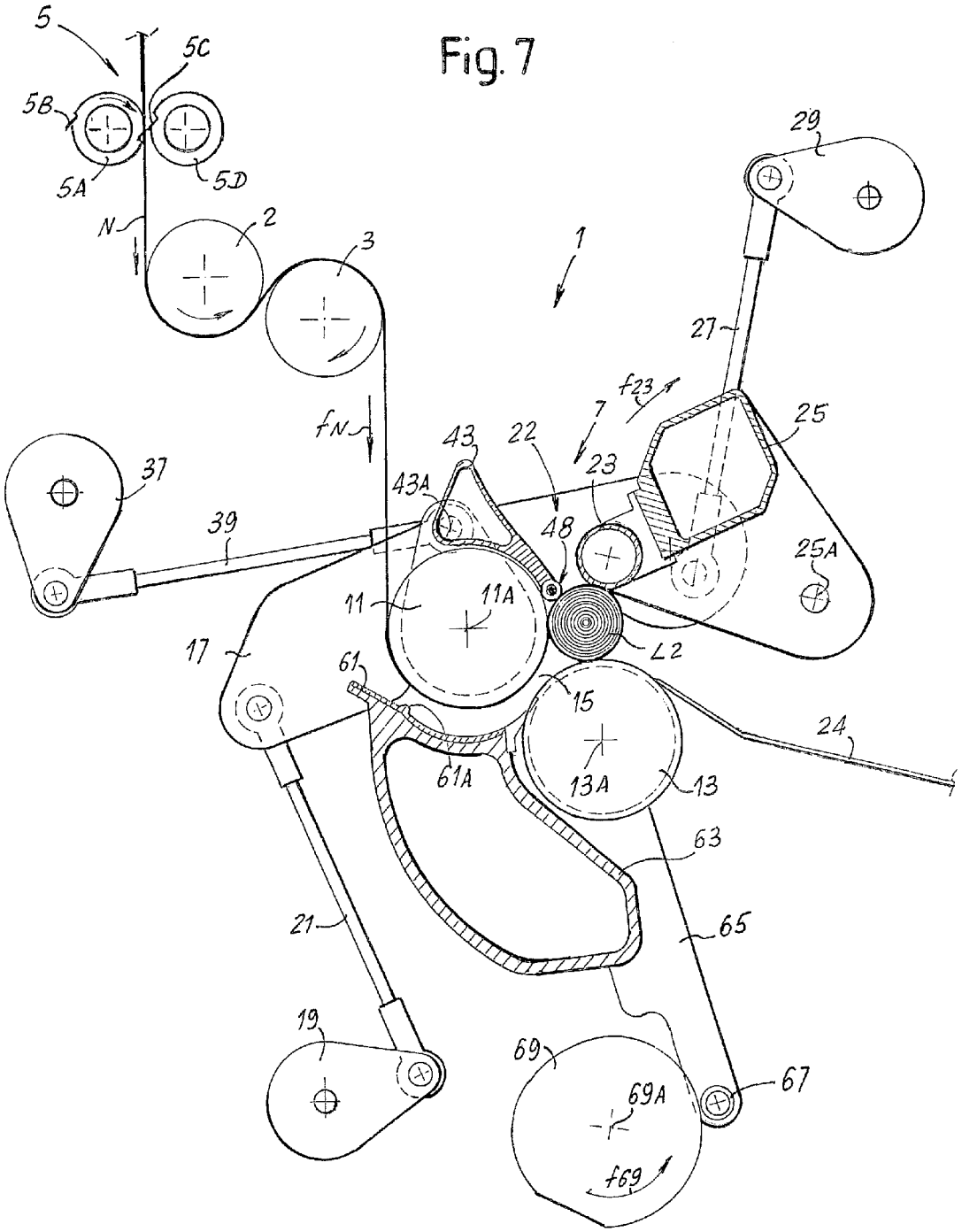

FIG. 6 shows the successive instant, when the third winding roller 23 has been lowered until its cylindrical surface achieves the surface of the roll L2 being formed. The roll L2 has increased in diameter relative to the phase shown in FIG. 5, and it moved forward, away from the laying plane of the axes of the winding rollers 11 and 13 and therefore away from the nip 15 between said rollers.

In the phase of FIG. 6, the roll L2 is preferably into contact with the first winding roller 11, the second winding roller 13, and the third winding roller 23, as well as with the auxiliary winding roller 48. Even if at this point it is possible to move the auxiliary winding roller 48 away from the roll L2 being formed, in an advantageous embodiment of the method according to the invention winding of the second roll L2 continues for a certain part of the winding cycle into contact with the four winding rollers 11, 13, 23, and 48, as it is visible by comparing FIGS. 6 and 7

The third winding roller 23 is gradually lifted (arrow f23 in FIG. 7) remaining into contact with the roll L2 being formed. This gradual lifting allows a diameter increase of the roll L2 being formed. This movement is controlled by the actuator 29 through the rods 27. The auxiliary winding roller 48 is analogously moved away from the nip 15 by making the flanks 33 pivot through the actuator 37 and the rods 39, so as to allow, in this case, the increase in the diameter of the log or roll L2 being formed. In this phase of the winding cycle the peripheral speeds of the four winding rollers 11, 13, 23, and 48 can be equal to one another.

A change in the rotation speed of one or more of the winding rollers is also possible, for instance to control and vary the winding density, or to recover any slackening occurred in the previous phases of the winding cycle, particularly during the exchange phase, i.e. the phase of severing the web material and starting the second roll L2.

Figure 8:
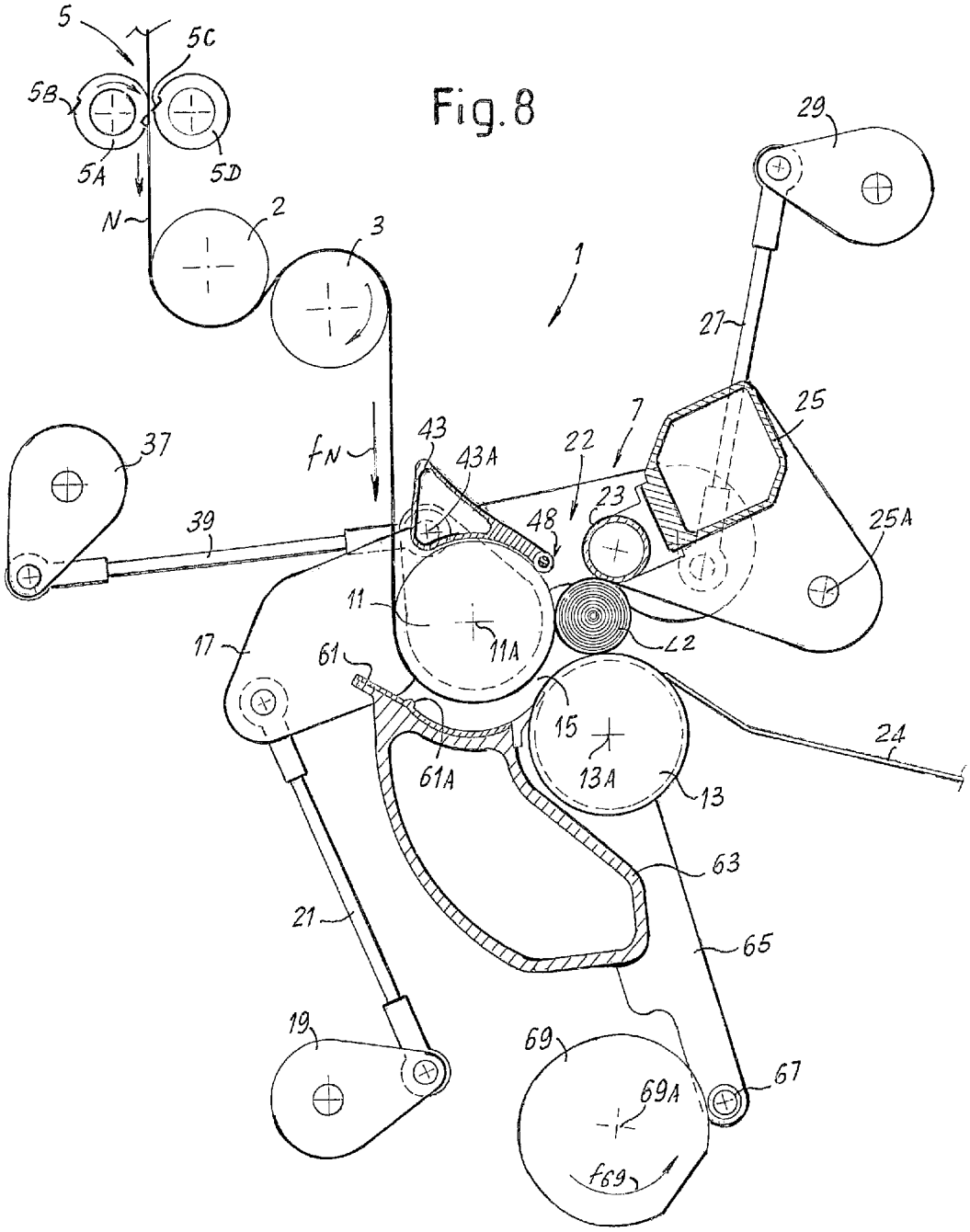

FIG. 8 shows a subsequent phase of the winding cycle, when the log or roll L2 is in contact only with the first winding roller 11, the second winding roller 13 and the third winding roller 23. This latter continues to be gradually raised due to the rotation of the arms 25 around the axis 25A controlled by the actuator 29 through the rods 27. The auxiliary winding roller 48 has been moved away from the roll L2 due to a further rotation of the flanks 33 around the axis of rotation of the first winding roller 11 through the actuator 37 connected to the flanks 33 by means of the rods 39.

In a modified embodiment it is possible for the auxiliary winding roller 48 to remain into contact with the roll L2 for a longer time or even for all the roll winding cycle. Winding of the roll L2 maintains this contact condition with the three winding rollers 11, 13, 23 nearly until the final quantity of web material N has been achieved. When winding is being completed, the roll L2 must begin to move away from the first winding roller 11 to achieve the position of the roll L1 of FIG. 3. To this end it is possible to modify the peripheral speed of one or both the winding rollers 13 and 23, as mentioned above.

A possible embodiment provides for the winding roller 13 to be decelerated, which roller in the previous winding phase, when the roll L2 has been arranged between, and into contact with, the rollers 11, 13, and 23, has been brought again to the peripheral speed equal to that of the roller 11 and of the roller 23. By causing a new deceleration of the winding roller 13, the roll L2 starts to move forward in the nip formed between the second winding roller 13 and the third winding roller 23, losing contact with the first winding roller 11 and moving away there from. In this way a free portion of web material N is formed (see FIG. 3), preparing the web material N for the subsequent severing or tearing phase due to the gripping against the surface of the winding roller 11 caused by the projection 61A of the plate 61.

In some embodiments it is also possible for the third winding roller 23 temporarily to accelerate, so as to cause an over-tension of the web material N and to make therefore the subsequent tearing of the web material faster and safer as soon as it is pinched between the cylindrical surface of the first winding roller 11 and the projection 61A of the plate 61. It is also possible to move the roll L2 away from the roller 11 due to the effect of the acceleration of the third winding roller 23 only, without decelerating the winding roller 13. Deceleration of the winding roller 13 is however advantageous to prepare the machine for the subsequent phase, wherein the new roll rolls through the nip 15, to move from the channel 62 to the nip 15 and from this latter toward the winding cradle delimited by the winding rollers 11, 13, 48 and then by the rollers 11, 13, 48, and 23.

From the description above it is clearly apparent that nearly all the winding cycle of each log or roll L1, L2 can be performed into contact with at least three winding rollers, thanks to the use of the winding roller 48 with a diameter substantially smaller than the diameter of the third winding roller 23. In fact, only the first turns, wound in the nucleus of the roll when this is in the nip 15, are formed into contact with only two winding rollers, i.e. the first winding roller 11 and the second winding roller 13, or between the first winding roller 11 and the substantially stationary surface of the plate 61. The contact with the auxiliary winding roller 48 (FIG. 4) starts extremely in advance of the moment when the third winding roller 23 can come into contact with the log or roll being formed. This occurs thanks to the fact that the auxiliary winding roller 48 has a very reduced diameter and also to the fact that it can come into operation, touching the roll L2, when the third winding roller 23 is still into contact with the roll L1, formed during the previous winding cycle, and is finishing the winding cycle of this roll L1, causing it gradually to roll around the second winding roller 13 until to achieve the chute 24.

In advantageous embodiments the rotary motion of the winding rollers 11, 13, 23, 48 is given by four distinct, electronically controlled, electric motors. Also the translation movement of the axes of the winding rollers 48, 11, and 23 is controlled by three distinct actuators (for instance electronically controlled electric motors). A fourth actuator causes the cam or eccentric 69 to rotate. All the actuators or motors, with which the rewinding machine is fitted, are adequately controlled by a single programmable electronic central control unit. Adequate encoders can be advantageously provided to verify the position of the various members and to give a feedback signal for the control rings.

It is understood that the drawing only shows an example provided by way of a practical arrangement of the invention, which can vary in forms and arrangements without however departing from the scope of the concept underlying the invention. Any reference numbers in the appended claims are provided for the sole purpose of facilitating reading of the claims in the light of the description and the drawing, and do not in any manner limit the scope of protection represented by the claims.

The invention claimed is:

1. A rewinding machine for producing rolls of web material, comprising: a path for feeding a web material; a first winding roller and a second winding roller defining a nip across which the web material passes; downstream of said nip, a third winding roller with movable axis, cooperating with the first winding roller and the second winding roller to form a winding cradle for rolls of said web material; an auxiliary winding roller with movable axis which can be inserted between the first winding roller and the second winding roller downstream of the nip to contact an outer surface of a roll of web material under formation.

2. The rewinding machine as claimed in claim 1, wherein said auxiliary winding roller has a diameter smaller than a diameter of each of the first winding roller, the second winding roller and the third winding roller.

3. The rewinding machine as claimed in claim 1, wherein said auxiliary winding roller is movable along a substantially circular trajectory nearly coaxial to the first winding roller.

4. The rewinding machine as claimed in claim 3, wherein said path for feeding the web material extends around the first winding roller.

5. The rewinding machine as claimed in claim 1, wherein said auxiliary winding roller is driven into rotation by an autonomous motor.

6. The rewinding machine as claimed in claim 1, wherein said first winding roller is supported with a movable axis.

7. The rewinding machine as claimed in claim 6, wherein said first winding roller is supported by a pair of arms hinged around a pivoting axis substantially parallel to the axis of rotation of said first winding roller.

8. The rewinding machine as claimed in claim 7, wherein said auxiliary winding roller is driven into rotation by at least one motor carried by one of said arms.

9. The rewinding machine as claimed in claim 1, wherein during a winding cycle of a roll, said first winding roller and said second winding roller have a variable center distance.

10. The rewinding machine as claimed in claim 1, wherein said auxiliary winding roller is supported by flanks coaxial to the first winding roller.

11. The rewinding machine as claimed in claim 10, wherein said flanks coaxial to the first winding roller pivot around the axis of the first winding roller.

12. The rewinding machine as claimed in claim 11, wherein said auxiliary winding roller is supported by a bearing structure hinged to said flanks that are coaxial to the first winding roller.

13. The rewinding machine as claimed in claim 12, wherein said bearing structure is biased towards a position of minimum distance to the first winding roller.

14. The rewinding machine as claimed in claim 13, wherein said bearing structure is biased by elastic members towards said position of minimum distance to the first winding roller.

15. The rewinding machine as claimed in claim 10, wherein said auxiliary winding roller is pivotally supported on said flanks that are coaxial to the first winding roller.

16. The rewinding machine as claimed in claim 10, wherein said flanks coaxial to the first winding roller are controlled by an actuator to cyclically pivot every winding cycle of a roll to move said auxiliary winding roller from a position of minimum distance to said nip to a position of maximum distance from said nip.

17. The rewinding machine as claimed in claim 1, further comprising a plate arranged upstream of said nip and defining with said first winding roller a channel inside which the winding of said rolls starts.

18. The rewinding machine as claimed in claim 17, wherein said plate is arched and extends around said first winding roller with a concavity facing the rotation axis of the first winding roller.

19. The rewinding machine as claimed in claim 17, wherein said plate is provided with a pivoting movement toward the first winding roller to pinch the web material against said first winding roller.

20. The rewinding machine as claimed in claim 1, wherein said third winding roller and said auxiliary winding roller are controlled so that while a first roll in the final winding phase is moved away from the first winding roller into contact with the second winding roller and the third winding roller, said auxiliary winding roller is inserted between the first winding roller and the third winding roller towards said nip, a second roll in initial winding phase passing across said nip and coming into contact with said auxiliary winding roller.

21. The rewinding machine as claimed in claim 20, wherein said third winding roller and said auxiliary winding roller are controlled so that when the first roll has been unloaded from the winding cradle, said third winding roller is put into contact with the second roll for at least one part of the winding cycle.

22. The rewinding machine as claimed in claim 1, further comprising a first motor, a second motor, a third motor and an auxiliary motor to drive into rotation said first winding roller, said second winding roller, said third winding roller and said auxiliary winding roller, said first motor, said second motor, said third motor and said auxiliary motor being controlled by a central control unit.

23. The rewinding machine as claimed in claim 22, further comprising independent actuators to move the axis of the first winding roller, the axis of the third winding roller and the axis of the auxiliary winding roller, said actuators being controlled by said central control unit.

24. A rewinding machine for producing rolls of web material, comprising: a path for feeding a web material; a first winding roller and a second winding roller defining a nip across which the web material passes; downstream of said nip, a third winding roller with movable axis, cooperating with the first winding roller and the second winding roller to form a winding cradle for rolls of said web material; an auxiliary winding roller with movable axis which can be inserted between the first winding roller and the second winding roller downstream of the nip; wherein said auxiliary winding roller is movable along a substantially circular trajectory nearly coaxial to the first winding roller; wherein said path for feeding the web material extends around the first winding roller; and wherein said auxiliary winding roller is supported by a plurality of support elements forming a comb-shaped bearing structure, the auxiliary winding roller being subdivided into a plurality of substantially coaxial cylindrical elements.

25. The rewinding machine as claimed in claim 24, wherein said cylindrical elements are keyed onto a common drive shaft, which is supported in a plurality of positions by said bearing structure.

26. A method for winding rolls of web material without winding core, comprising:

providing a first winding roller and a second winding roller defining a nip therebetween, across which a web material is fed;

providing a third winding roller with movable axis downstream of said nip, defining with said first winding roller and said second winding roller a winding cradle;

winding at least one part of a first roll of web material in contact with said first winding roller, said second winding roller and said third winding roller;

moving the first roll away from the first winding roller maintaining the first roll in contact with said second winding roller and said third winding roller;

inserting an auxiliary winding roller between said first roll and said first winding roller downstream of the nip to contact an outer surface of the roll under formation;

interrupting the web material at end of winding of said first roll, and, thereafter, starting winding a second roll and engaging said second roll in an initial winding phase between said first winding roller, said second winding roller and said auxiliary winding roller.

27. The method as claimed in claim 26, further comprising unloading the first roll from the winding cradle;

moving the third winding roller toward the second roll, maintaining the second roll in contact with said first winding roller, said second winding roller and said auxiliary winding roller for a part of the winding.

28. The method as claimed in claim 27, further comprising moving the auxiliary winding roller away from the second roll, continuing winding the second roll in contact with the first winding roller, the second winding roller and the third winding roller.

* * * * *